United States Patent [19]

Sparling

[11] Patent Number: 4,685,565

[45] Date of Patent: Aug. 11, 1987

[54] INTERCONNECTABLE BEVERAGE CONTAINER SYSTEM

[76] Inventor: Michael Sparling, 34 Tyler St., Rochester, N.Y. 14621

[21] Appl. No.: 822,148

[22] Filed: Jan. 24, 1986

[51] Int. Cl.[4] ..... B65D 21/02

[52] U.S. Cl. ..... 206/427; 206/504; 206/509; 220/23.4; 215/10

[58] Field of Search ..... 206/427, 504, 509; 220/23.4; D9/410, 411; 215/10; 446/127

[56] References Cited

U.S. PATENT DOCUMENTS

| | | | |
|---|---|---|---|
| 3,225,951 | 12/1965 | Poston et al. | 220/23.4 |
| 3,300,041 | 1/1967 | Fuller | 206/161 |
| 3,374,917 | 3/1968 | Troy | 215/10 |
| 3,587,910 | 6/1971 | McCarthy | 220/23.4 |
| 3,713,247 | 1/1973 | Parrilla | 446/127 |
| 4,416,373 | 11/1983 | deLarosiere | 220/23.4 |
| 4,509,639 | 4/1985 | Thompson | 206/427 |
| 4,552,396 | 11/1985 | Rais | 215/100 A |
| 4,570,799 | 2/1986 | Mednis | 215/10 |

FOREIGN PATENT DOCUMENTS

| | | | |
|---|---|---|---|
| 263450 | 7/1963 | Australia | 220/23.6 |
| 1225233 | 6/1960 | France | 215/10 |
| 1480678 | 4/1967 | France | 215/10 |

*Primary Examiner*—William Price
*Assistant Examiner*—Brenda J. Ehrhardt
*Attorney, Agent, or Firm*—Bruns and Wall

[57] ABSTRACT

An interconnectable beverage container system has tongue and groove members spaced at regular intervals about the periphery of the body of each container. The tongue members each have a front surface and a pair of oppositely disposed axially extending undercut sides, and the groove members each have a pair of oppositely disposed undercut axially extending projections defining a void or groove. The tongue member slides snugly into a respective groove member of another container. Neck plates or neck flanges have lobes that extend radially outward substantially to the periphery of the container, with cutouts between successive lobes. The respective cutouts of a cluster of containers combine to form fingerholes for lifting the cluster of containers.

14 Claims, 4 Drawing Figures

INTERCONNECTABLE BEVERAGE CONTAINER SYSTEM

BACKGROUND OF THE INVENTION

This invention relates generally to packaging, and is more particularly directed to containers for beverages or the like, e.g., soft drink bottles or beer bottles. More specifically, the invention is concerned with containers having integral interconnective means for forming a multi-pack cluster of the containers without requiring any paper, paperboard, plastic film or other additional packaging material to form the multi-pack cluster.

Beverages, foods and other products have long been sold as individual containers packaged together in a multi-pack sales unit, such as the popular six-pack or twenty-four bottle case. These clusters are typically held together with paper, cardboard, cellophane, or plastic film packaging material. Usually, this must be torn to remove the individual bottles and the packaging material must be discarded. Thus, the packaging material constitutes a source of waste and litter, as well as an additional manufacturing or packaging cost.

Recently, several states have enacted so-called "Bottle-Bill" legislation, under which the consumer pays a deposit (typically five cents) for each bottle or container of soft drink or beer, and a merchant or recycle center returns this deposit when the consumer brings in the cleaned, empty containers. Typically, the containers must be grouped according to brand for cost accounting purposes. The bottle returns are then sent back to the beer or soft drink distributor, and are eventually refilled (for some glass bottles) or broken up for scrap (for steel and aluminum cans, one-way glass bottles, and plastic bottles).

Handling and temporary storage of the empty returnables has thus presented problems for the consumer, the merchant, and the distributor.

A number of attempts have been made to package beverages and the like to facilitate clustering the full or empty containers. Jennison U.S. Pat. No. 4,165,812 relates to milk containers with male and female connections, and which snap together to form a cluster of four bottles. Wells et al U.S. Pat. No. 4,003,491 relates to interconnectable cans, bottles, and the like with alternate ribs and recesses that permit a cluster of the containers to be snapped together. Other interlockable container systems have also been proposed, e.g. in U.S. Pat. Nos. 4,139,114 and 3,994,408. However these employ a snap lock system, and none uses or suggests a slide-lock interconnection system; consequently, the integrity of a cluster or multi-pack is less than acceptable for commercial handling and distribution purposes. Further, none of these prior proposals provides a useful handle to facilitate lifting a multi-pack cluster in either the full or empty state.

OBJECTS AND SUMMARY OF THE INVENTION

Accordingly, it is an object of this invention to provide a bottle suitable for soft drinks, beer, other beverages, or the like and which can be interconnected with one another to form a multi-pack cluster.

It is another object of this invention to provide such a container whose structure forms convenient fingerhole handles for the multi-pack cluster.

It is yet another object of this invention to provide a container system which avoids the wasteful need for paper, cellophane, plastics or other packaging materials, thereby avoiding litter and protecting the environment.

It is still another object of this invention to provide a container system which facilitates the return of empty containers.

In accordance with an aspect of this invention, a container for beverages or the like is formed so as to be connectable with a plurality of like containers to form a multi-pack cluster without external binding material. The container of this invention comprises a neck portion and a body portion coaxial with it, the body portion having a plurality of axially-extending male tongue members and a plurality of axially-extending female groove members. The tongue members and the groove members are disposed at regular spaced intervals about the periphery of the body portion of the container, with the tongue members each having a front facing surface and a pair of oppositely disposed, axially extending undercut sides. The groove members each have a pair of oppositely disposed undercut axially extending projections that define a void between them, such that the male tongue member slides fits snugly in the axial direction into the void of the respective female groove member of another container of the cluster. In a preferred embodiment, the container has two of the tongue members diametrically opposed on the container, and two of the groove members also diametrically disposed thereon. To facilitate lifting the multi-pack cluster of these containers, each container has a neck flange or neck plate integrally formed with the neck portion, and extending radially outwards towards the periphery of the container. The neck plate is formed of a plurality of lobes that define cutouts between adjacent lobes. When the containers are joined one to another, the respective cutouts of the adjacent joined containers together define fingerholes so that the cluster of containers can be lifted by their neck plates.

The above and many other objects, features and advantages of this invention will be more fully understood from the ensuing detailed description of a preferred embodiment, when considered in connection with the accompanying drawings.

DETAILED DESCRIPTION OF THE PREFERRED EMBODIMENT

Figure 1:
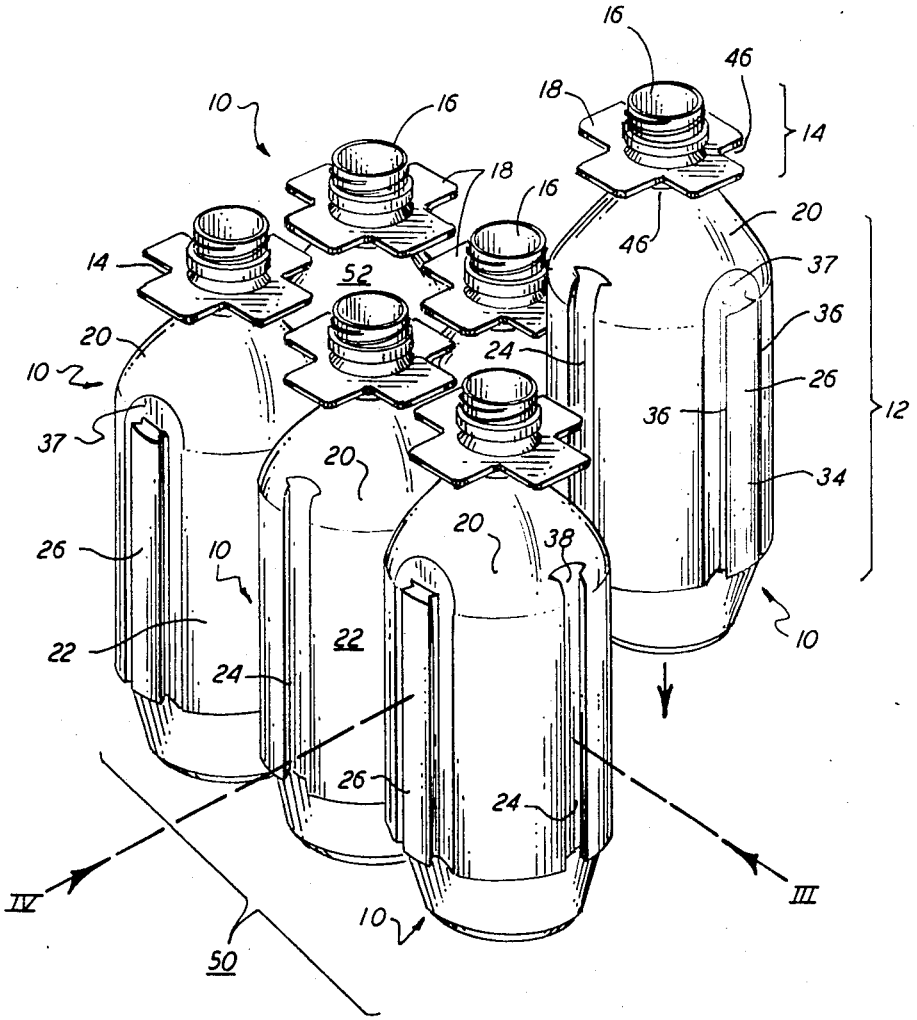
FIG. 1 is a perspective view of a cluster of containers according to a preferred embodiment of this invention.

With reference to FIGS. 1–4 of the drawings, an interconnectable bottle or beverage container 10 is shown. The container as shown is a twelve ounce bottle suitable for soft drinks, beer, or other beverages, and is of a type of plastic synthetic resin which can be blow molded or otherwise formed. The containers of this embodiment are favorably dimensioned so as to be employed in a standard bottle filler line at a bottling plant or brewery, without significant modification to the filler line.

As illustrated, the bottle or container 10 has a body portion 12 which is generally cylindrical in shape, and a neck portion 14. The neck portion has a threaded open top 16 to receive a mating threaded crown or other closure (not shown) and has a lateral flange or neck plate 18, which can serve as a handle for lifting the container 10. A conic shoulder or funnel portion 20 connects the body portion 12 with the neck portion 14.

A side wall 22 of the container body portion 12 has a pair of diametrically opposed female longitudinal connecting members 24, and also has a pair of male longitudinal connecting members 26.

Each longitudinal female connecting member 24 includes a recess 28 that is defined by a pair of undercut sides 30, the sides 30 extending parallel to one another and for the axial extent of the periphery of the container side wall. Each male connecting member 26 is formed of a tongue or projection 32 having a cylindrical front or facing wall 34, having a pair of undercut sides 36. A concave cylindrical surface 37 surrounds each projecting tongue 32.

As is shown in the drawings, each female connecting portion has the recess 28 open at a top end 38 and at a bottom end 40 thereof. The containers are interconnected with one another simply by sliding the male connectors 26 axially, i.e., longitudinally into the female connectors 24 of adjacent ones of the containers 10 to form a multi-pack cluster. This interconnection is shown favorably in the plan view of FIG. 2.

Figure 2:
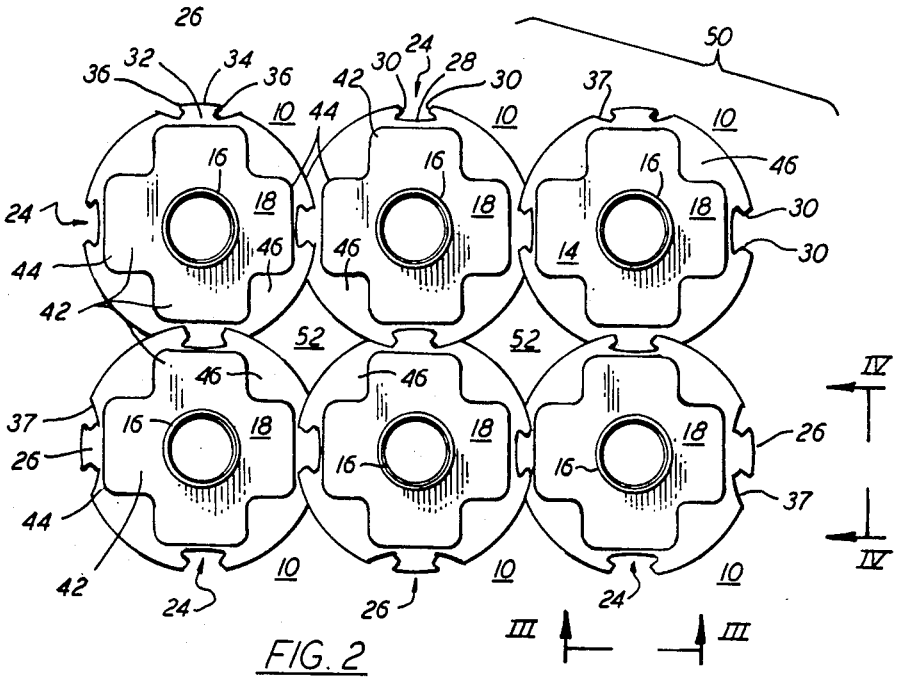
FIG. 2 is a top plan view of the cluster of containers.
Figure 3:
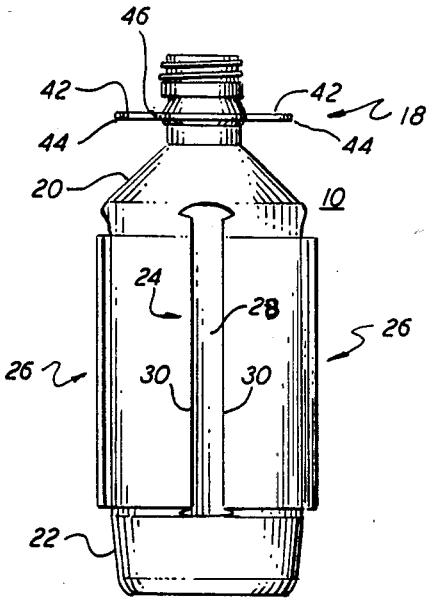
FIGS. 3 and 4 are side elevational views, taken in the directions III and IV, respectively, of the preferred embodiment of the container of this invention.
Figure 4:
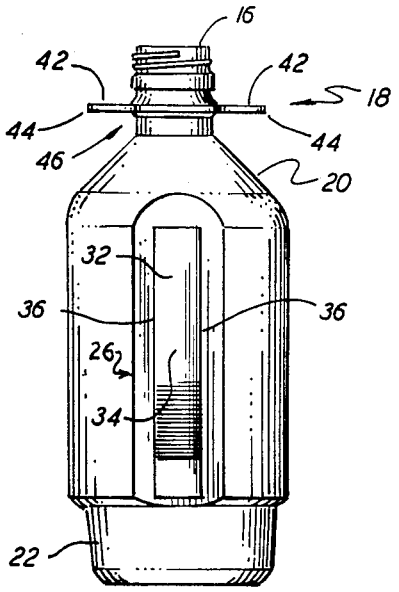

The neck flanges 18 are here formed of four lobes 42 directed ninety degrees apart. Outermost edges 44 of these lobes 42 are disposed radially inward of the positions of the connecting members 24, 26 to leave a clearance for the insertion of the male members 26 into the female members 24 without the neck plate 18 interfering therewith. The lobes 42 have recesses 46 between successive ones of the lobes 42, with the recesses appearing at positions midway between successive ones of the connecting members 24, 26. Accordingly, when the containers 10 are assembled together to form a multipack cluster 50, as shown, e.g. in FIGS. 1 and 2, the recesses 46 for each of the adjacent containers cooperate with one another to define fingerholes 52. The fingerholes 52 here formed by the four cooperating recesses 46 of the neck plate 18 of the four adjacent bottles 10. In a six-pack cluster 50, as shown in FIG. 2, there are two such fingerholes 52.

The tongue and groove arrangement of the male and female connecting members 26, 24 for adjacent containers in the cluster 50 provide a snug and secure fit, without the necessity of paper, plastic film or other binding material. That is, the beverages can be sold in clusters having only the containers, the beverage, and the closures or caps, thus eliminating a manufacturing procedure and cost associated with the packaging material.

It is evident that additional containers 10 can be clustered together to form a cluster of any arbitrary number of containers as well as the units of conventional size, such as 4, 6, 12, 24 or 36 containers. Filled bottles can be packaged as six-packs or as four such six-packs as separate units in twenty-four bottle case units of sales, with the six-pack units being formed without paper or plastic or metal packaging materials, simply by joining together the containers by means of the female and male tongue and groove connecting members 24, 34. The cases can be delivered in existing cartons for ordinary bottles. If the containers 10 are returnable bottles, the containers 10 can be easily stacked and stored, and can be clustered to form a convenient structure to facilitate counting and checking the returnable containers; the clusters form a convenient mode for storage until later collection by the soft drink or beer distributor. The empty bottles being returned to stores or redemption centers, or to distributors, may be joined together in clusters of twenty-four, independent of the cardboard case tray or carton which is used for shipment of four six-packs from bottler to distributor. These case trays can be reused, in which case the only packaging material necessary for delivery of the bottles to the distributor will be the case tray or carton.

As shown in this embodiment, the undercut portion 36 of the male tongues 32 and the undercut sides 30 of this female connecting members 24 are angled and dimensioned so as to have a significant gripping contact area. The female groove members 24 do not yield to sideward force, so with the structure as shown herein, the containers 10 connect and disconnect with respect to one another only by sliding the tongue and groove connecting arrangement 24, 26 longitudinally: the containers 10 do not snap or unsnap laterally from one another.

The containers of this embodiment can easily be formed from a parison of a convenient plastic synthetic material, forming the containers 10 in a blow mold. Alternatively, any other convenient bottle forming technique could be used. The containers of this invention can be recycled either by refilling or by grinding up the containers 10 for recycling, e.g. as paint, etc.

While a preferred embodiment has been described in detail hereinabove, it should be recognized that many alternative arrangements would present themselves to those of skill in the art without departing from the principles of this invention. For example, the tongue and groove connecting members could be disposed at other than 90° intervals around the container 10. In one possible alternative, there could be six such connectors, disposed, e.g., male, female, female, male, female, female. Also, as an alternative to the disclosed embodiment, the two pairs of connector members 24, 26 could be disposed around the container side wall 22 in the order male, male, female, female. Still further, it should be recognized that the container is not limited to its contents, and could be employed for containing a liquid or fluid other than beer or soft drinks, e.g. lubricants, copy machine toner, etc. Furthermore, the containers need not be of twelve ounce size, but could be any convenient size, e.g. four, six, seven, eight, ten, sixteen ounce, quarter liter, half liter, etc.

Accordingly, the scope and spirit of this invention is to be defined by the appended claims.

I claim:

1. A container for beverages or the like which is connectable with a plurality of like containers to form a multi-pack cluster of said containers without necessity of an external binding material, the container having a longitudinal axis and comprising a neck portion having a sealable opening thereon and a round body portion coaxial therewith and having a generally cylindrical sidewall of a predetermined radius, a plurality of axially extending male tongue members and a plurality of axially extending female groove members, said tongue members and said groove members being spaced at regular intervals about the periphery of said body portion, said tongue members each having a front surface situated radially within said radius and a pair of oppositely disposed axially extending undercut sides, and said groove members each having a pair of oppositely disposed undercut axially extending projections defining a void therebetween, said tongue member being snugly slidable in the axial direction into the void of a respective groove member of another container in said cluster.

2. The container of claim 1 in which said container has two of said tongue members diametrically disposed thereon and two of said groove members diametrically disposed thereon.

3. The container of claim 1 in which said tongue members alternate with said groove members.

4. The container of claim 1 in which said tongue members are disposed substantially 90 degrees from said groove members.

5. The container of claim 1, further comprising a neck plate extending radially outward from said neck portion substantially to the radial position of said tongue and groove members.

6. The container of claim 1, wherein the axially extending undercut sides of each of said tongue members are generally along parallel lines in the axial direction, but diverge in the radial direction, and the axially extending undercut projections of said groove members are likewise generally along parallel lines in the axial direction but converge in the radial direction.

7. The container of claim 6, wherein said groove members and said tongue members are unyielding to one another sufficiently to prevent snapping apart of said tongue members.

8. The container of claim 1, wherein said groove members are each open at top and bottom ends thereof for slideably receiving a mating one of the tongue members of another like container.

9. A container for beverages or the like which is connectable with a plurality of like containers to form a multi-pack cluster of said containers without necessity of an external binding material, the container having a longitudinal axis and comprising a neck portion having a sealable opening thereon and a body portion coaxial therewith and having a plurality of axially extending male tongue members and a plurality of axially extending female groove members being spaced at regular intervals about the periphery of said body portion, said tongue members each having a front surface and a pair of oppositely disposed axially extending undercut sides, and said groove members each having a pair of oppositely disposed axially extending projections defining a void therbetween, said tongue member being snugly slidable in the axial direction into the void of a respective groove member of another container in said cluster, and further comprising a neck plate extending radially outward from said neck portion substantially to the radial position of said tongue and groove members, wherein said neck plate is provided with cutouts between the positions of said tongue and groove members such that the cutouts of a cluster of said containers joined together by mating their respective tongue and groove members define a fingerhole to facilitate lifting the cluster of containers by said neck plate.

10. The container of claim 9 wherein said body portion has a generally cylindrical side wall of a predetermined radius from said axis, and said tongue and groove members are disposed radially within the radius of said body portion side wall.

11. A container for beverages or the like which is mechanically connectable with a plurality of like containers to form a multi-pack cluster of said containers without requiring an external binding material, each container having an axis and comprising an elongated body portion and a coaxial neck portion having a sealable opening, said body portion including a plurality of axially slideably connecting means integrally formed with the container body portion about the periphery thereof and mating means integrally formed with the container body portion about the periphery thereof for slidably receiving the connecting means of another container in the cluster, and a neck plate integrally formed with said neck portion and extending radially outward therefrom substantially to the periphery of said container, with cutouts therein between positions of said connecting means and mating means, such that respective cutouts of the cluster of said containers, formed by mating their respective connecting and mating means, together define a fingerhole to facilitate lifting the cluster of containers by said neck plates.

12. The container of claim 11 in which the connecting means include axially extending projections having undercut sides, and said mating means include axially extending recesses having undercut side walls the recesses being open at their ends to permit sliding insertion of the projection of an associated container into the top or the bottom of the recess of the first-mentioned container; and in which said neck plate has lobes terminating, in the direction of said recesses and said projections, closer to said axis than the innermost positions of said recesses, so that the neck plate does not interfere with the insertion of one said container into a cluster of the same.

13. The container of claim 11 in which there are a pair of said connecting means and a pair of said mating means, said connecting and mating means being spaced substantially 90 degrees apart on the periphery of said body portion, and in which said neck plate is generally cruciform with lobes extending in the radial directions of said connecting and mating means.

14. The container of claim 11 wherein said body portion has a generally cylindrical side wall of a predetermined radius from said axis, and said mating means are disposed radially within the radius of the body portion side wall.

* * * * *